US009598205B2

(12) United States Patent
Shuert

(10) Patent No.: US 9,598,205 B2
(45) Date of Patent: Mar. 21, 2017

(54) SINGLE SHEET MOLDED PLASTIC PALLET

(71) Applicant: Shuert Technology, LLC, Sterling Heights, MI (US)

(72) Inventor: Lyle H. Shuert, Birmingham, MI (US)

(73) Assignee: Shuert Technology, LLC, Sterling Heights, MI (US)

( * ) Notice: Subject to any disclaimer, the term of this patent is extended or adjusted under 35 U.S.C. 154(b) by 0 days.

(21) Appl. No.: 15/175,663

(22) Filed: Jun. 7, 2016

(65) Prior Publication Data

US 2017/0008667 A1 Jan. 12, 2017

Related U.S. Application Data

(60) Provisional application No. 62/188,931, filed on Jul. 6, 2015.

(51) Int. Cl.
*B65D 19/04* (2006.01)

(52) U.S. Cl.
CPC .... *B65D 19/04* (2013.01); *B65D 2519/00034* (2013.01); *B65D 2519/00069* (2013.01); *B65D 2519/00174* (2013.01); *B65D 2519/00268* (2013.01); *B65D 2519/00796* (2013.01)

(58) Field of Classification Search
CPC ..... B65D 19/04; B65D 2519/0034; B65D 2519/0069; B65D 2519/00174; B65D 2519/0068; B65D 2519/00796
See application file for complete search history.

(56) References Cited

U.S. PATENT DOCUMENTS

| | | | | |
|---|---|---|---|---|
| 3,680,495 | A | 8/1972 | Pike | |
| 3,699,901 | A | 10/1972 | Cook, III | |
| 3,702,100 | A * | 11/1972 | Wharton | B65D 19/0012 108/53.3 |
| 3,707,127 | A | 12/1972 | Palfey | |
| 3,944,070 | A * | 3/1976 | Cardwell | B65D 19/004 108/53.1 |
| 4,254,873 | A | 3/1981 | Cook, III et al. | |
| 4,879,956 | A | 11/1989 | Shuert | |
| 5,042,396 | A | 8/1991 | Shuert | |
| 5,391,251 | A | 2/1995 | Shuert | |
| 5,555,820 | A | 9/1996 | Shuert | |
| 5,794,544 | A | 8/1998 | Shuert | |
| 7,275,489 | B1 * | 10/2007 | Shuert | B65D 19/0018 108/57.25 |
| 7,624,689 | B2 * | 12/2009 | Shuert | B65D 19/0036 108/57.25 |

(Continued)

*Primary Examiner* — Daniel Rohrhoff
(74) *Attorney, Agent, or Firm* — Young Basile Hanlon & MacFarlane, P.C.

(57) ABSTRACT

A single sheet unitary molded plastic pallet has nine open top molded plastic leg structures extending to a common floor plane wherein the leg structures are arranged in three columns and three rows and include a center leg structure. The pallet also has connector structures arranged between the leg structures and having corner ribs extending therefrom to the leg structures so as to provide a floor plane which is substantially continuous in all directions, and a load plane which is substantially continuous in all directions. The side surfaces of the connector structures having opening for forklift tangs. The pallet has a continuous peripheral lip which can accept an elasticized load cover.

8 Claims, 9 Drawing Sheets

(56) References Cited

U.S. PATENT DOCUMENTS

| | | | | |
|---|---|---|---|---|
| 2003/0110990 | A1* | 6/2003 | Apps | B65D 19/0016 108/57.25 |
| 2003/0136314 | A1* | 7/2003 | Smyers | B65D 19/0012 108/57.26 |
| 2012/0181214 | A1* | 7/2012 | Kernen | B65D 19/04 206/596 |

* cited by examiner

SINGLE SHEET MOLDED PLASTIC PALLET

CROSS REFERENCE OF CO-PENDING APPLICATION

This application claims the benefit of U.S. provisional patent application Ser. No. 62/188,931 filed Jul. 6, 2015, the entire contents of which are incorporated herein in its entirety.

FIELD OF THE INVENTION

This invention disclosure relates to molded plastic pallets, and more particularly to a single sheet pallet which offers the advantages of many twin sheet, double faced pallets.

BACKGROUND OF THE INVENTION

It is known to manufacture shipping pallets from plastic materials such as high density polyethylene (HDPE), polypropylene, and other polymers. Pallets can be single sheet or double sheet and can be manufactured using thermoforming and injection molding techniques.

Single sheet pallets have the advantage of lighter weight, but often exhibit a number of disadvantages including excessive flexibility, incompatibility with roller conveyors and the absence of safety straps on the bottoms of the forklift openings to prevent inadvertent separation of a loaded pallet from the tangs of a forklift truck.

Double skin, or "twin sheet" pallets solve many of the forgoing problems, but often exhibit their own disadvantages including greater weight and higher costs due to the use of a greater volume of plastic material as well as more complex fabrication techniques as a result of the need to form both upper and lower sheets and then join the two sheets together to form a unitary structure.

BRIEF SUMMARY OF THE INVENTION

The present invention provides a single sheet pallet having the advantages of a twin sheet pallet, but at substantially lesser cost and with simpler manufacturing techniques; for example, the present pallet may be vacuum thermoformed rather than injection molded, using only a single mold. However, if desired, the pallet may be compression molded using complemental upper and lower molds, or it may be injection molded.

Among the advantages provided by a pallet as disclosed herein are:

- Four-way forklift entry with safety straps under all of the forklift entry points in all directions;
- Nestability;
- Substantial resistance to deflection when loaded;
- Compatibility with stretch plastic wrapping techniques as a result of the presence of a peripheral lip around the upper boundary of the pallet which is greater in width and length than the underlying but integral base structure;
- Rigidity without a need for metal reinforcement;
- Compatibility with roller conveyors; and
- High load capability.

In the single embodiment disclosed herein, the pallet has nine legs; i.e., three rows of three legs each, but adjacent legs are all interconnected by structure which has a bottom surface on the same floor plane as each of the nine regular legs, these connectors having geometries that substantially increase the amount of surface area available on the floor plane and provide continuity which allows the pallet to roll over a roller conveyor.

As hereinafter described; the pallet is characterized by an upper structure including a bowl-shaped peripheral lip with radiussed corners and an underlying base structure wherein the dimensions of the peripheral lip structure are greater in both width and length than those of the base structure. This allows for the use of a plastic or fabric load cover which is stretched around the lip and then relaxed under the under surface of the radiussed peripheral lip to snugly hold the load to the pallet and effectively unitize the pallet and load so as to minimize or even eliminate the tendency of the pallet to deflect. The base structure includes the legs and the connectors, the latter being trimmed out in a secondary operation to form forklift openings.

In addition, the pallet includes a number of closed top load support structures of which four are arranged around but inverted relative to the center leg to provide load surfaces of substantial area on which items to be carried can be stacked and wrapped as necessary.

BRIEF DESCRIPTION OF THE DRAWINGS

The foregoing features and advantages of the present invention as well as others will be best understood from a reading of the following specification to which is to be taken with the accompanying drawings in which.

DETAILED DESCRIPTION OF THE ILLUSTRATIVE EMBODIMENT

The following description pertains to an illustrative embodiment of the present invention in the form of a thermoformed HDPE single sheet industrial pallet using 250 gauge (quarter inch thick) plastic with dimensions of 1100 by 1300 millimeters and a resulting weight of approximately twenty pounds. While these specifications are given by way of example, it is to be understood that the pallet may be made from different materials such as polypropylene, may be injection or compression molded rather than thermoformed, and may be made in different sizes and in different gauges as suits the needs of the particular application.

The pallet 10 as hereinafter described has the characteristics of light weight in proportion to the load carrying capability and size, four-way forklift entry with safety straps, nestability, and compatibility with roller conveyors as a result of a floor plane surface which provides substantially continuous contact with the rollers of a roller conveyor during movement there over. In general, many of the foregoing characteristics are accomplished through the provision of pallet legs which create a base structure which is narrower and shorter than the peripheral upper structure, which provides nine legs in three rows of three each including a center leg, but which further provides connector structures between legs wherein the connector structures generally run diagonally between legs. The base or lower structure provides large areas of floor plane material. Because the upper structure includes a peripheral lip that is both larger and wider than the base structure, the pallet readily accepts a stretch type plastic load cover which conforms tightly around the curved upper peripheral lip 12 to rigidify the structure, prevent deflection, and hold the load in place.

Figure 1:
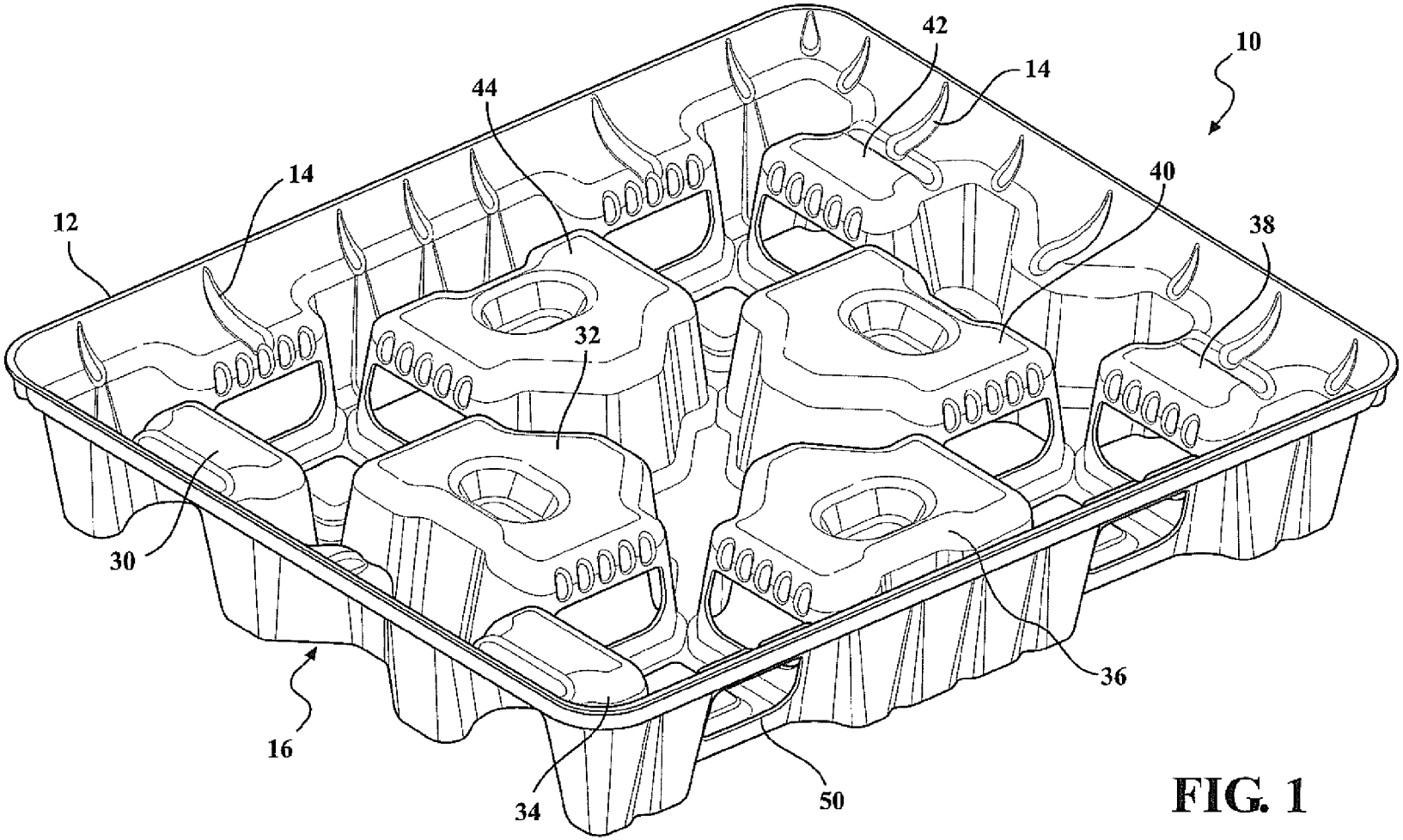
FIG. 1 is a top perspective view of an illustrative embodiment of the invention showing the details of the upper surface and several fork lift openings.

As shown in the Figures, the thermoformed plastic pallet 10 is rectangular in overall shape and has the aforementioned upper level downward and inwardly curved peripheral lip 12 with radiussed corners and with rigidifying features 14 molded into all four of the peripheral portions of the lip 12. As used herein, the word "curved" refers to the shallow bowl-like character of the peripheral upper structure. The lip 12 is continuous all the way around the pallet 10; i.e., there are two parallel long legs and two parallel shorter legs to the upwardly opening curved lip 12 as best shown in FIGS. 1-4. The shorter and longer legs of the lip 12 are integrally joined by rounded corners as best shown in FIG. 1.

The pallet 10 further comprises an integral lower base structure 16 which is molded to provide nine legs including four corner legs 18*a*, 18*b*, 18*c*, 18*d*, four intermediate legs 20*a*, 20*b*, 20*c*, 20*d*, which lie centrally between the adjacent corner legs, and a cruciform center leg 22. All nine of the legs extend downwardly to closed bottom surfaces in a common floor plane on which the pallet rests in use. All of the legs are tapered and the sidewalls are preferably contoured with vertical recesses 19 for added rigidity.

Figure 2:
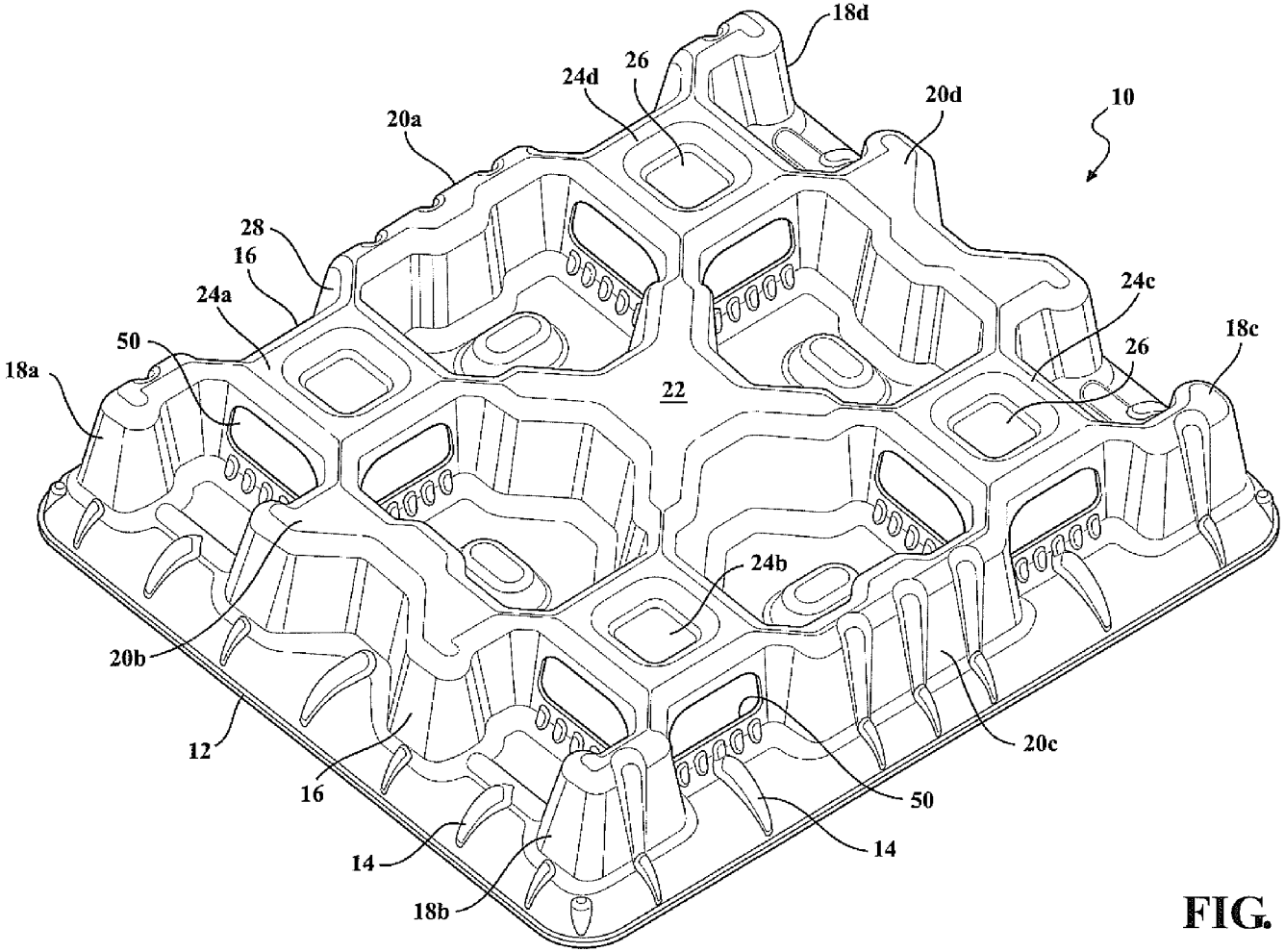
FIG. 2 is a bottom perspective view showing the details of the lower surface of the illustrative embodiment.
Figure 4:
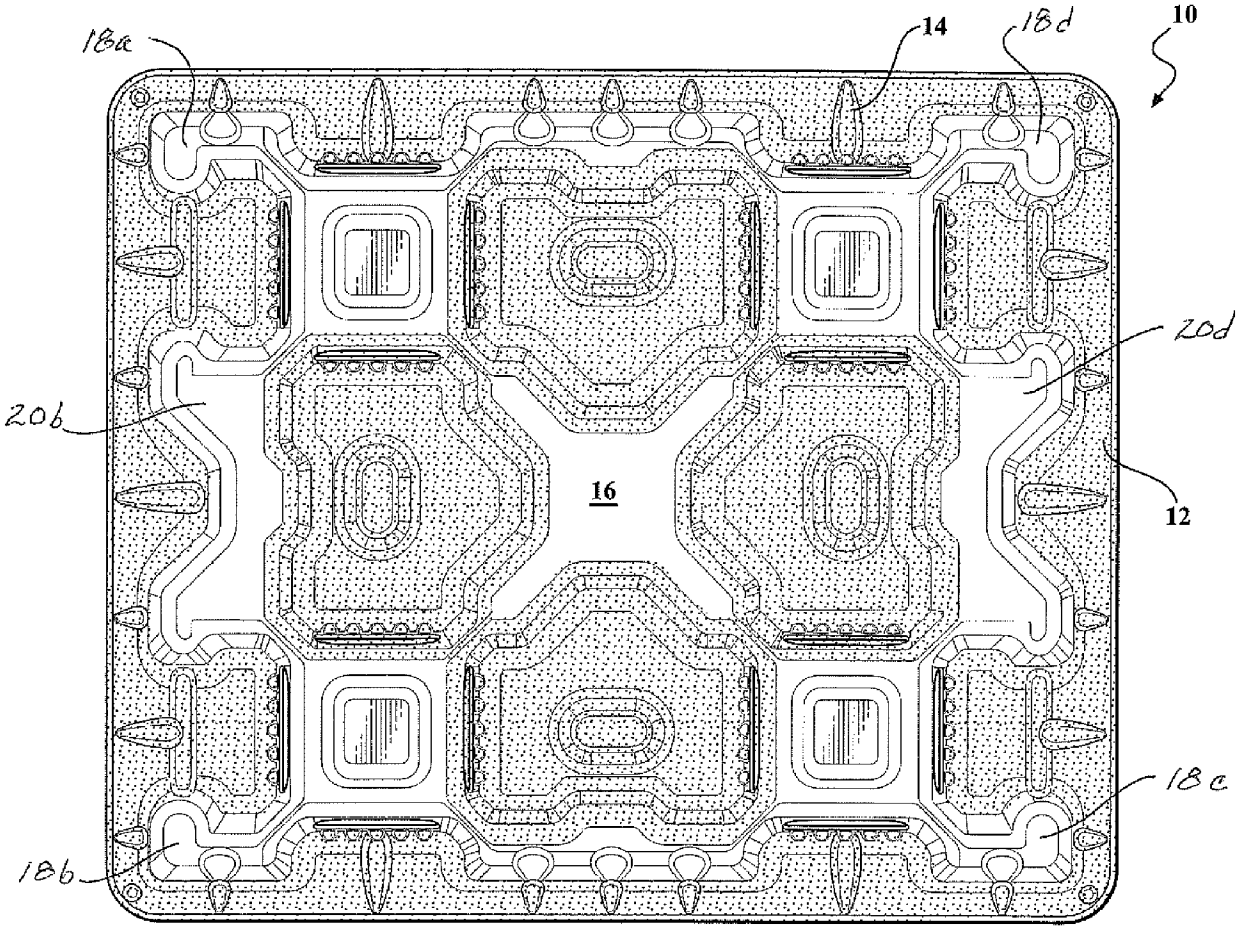
FIG. 4 shows the bottom of the pallet of FIG. 1 in plan view in which the shaded areas are in lower planes than the unshaded areas.

In addition to the legs 18, 20, and 22, intermediate connector structures 24*a*, 24*b*, 24*c*, 24*d*, are integrally molded into the pallet base structure as best shown in FIG. 2. Each of the connector structures 24*a*, 24*b*, 24*c*, 24*d*, has a ground level or floor plane surface that is essentially square in shape and has a center depression 26 for rigidification purposes. Corner extensions 28 reach from the corners of the square intermediate structures 24 over to the corners of adjacent corner legs and/or intermediate legs and/or center leg 22. As a result, every leg is structurally joined to all of its adjacent neighbors and the floor plane structure is substantially continuous in both east-west and north-south directions as shown in FIG. 4.

By way of example, the connector 24*a* has corner extensions 28 which reach the corner leg 18*a*, the intermediate leg 20*b*, the center leg 22 and the intermediate leg 20*a*. Further by way of example, connector structure 24*b* has corner extensions running to the intermediate leg 20*b*, the corner leg 18*b*, the intermediate leg 20*c* and the center leg 22.

Further, the connector structure 24*c* has connectors extending from the four corners thereof to the intermediate leg, the corner leg 18*c*, the intermediate leg 20*d* and the center leg 22.

The connector structure 24*d* has radial connector legs extending to the intermediate leg 20*a*, the center leg 22, the intermediate leg 20*d*, and the corner leg 18*b*.

It can be seen particularly in FIGS. 2 and 4 that there is a continuous, i.e., mono-planar floor engaging surface running diagonally across the bottom of the pallet 10 from corner leg 18*a* to corner leg 18*c*, and a similar mono-planar floor plane surface running from the corner leg 18*b* diagonally across the pallet to the corner leg 18*d*. All of the legs 18*a-d* and 20*a-d*, as well as the connectors 24*a-d* and the center leg 22 have floor plane surfaces.

As a result, there is a continuous floor plane level surface area between adjacent corner legs. For example, a continuous albeit not straight line floor plane surface extends from corner leg 18*a* through the connector 24*a* to the intermediate leg 20*b* and through the connector 24*b* to the corner leg 18*b*. Similarly, a continuous floor plane surface runs from corner leg 18*b* through the connector 24*b* to the intermediate leg 20*c* and through the connector 24*c* to the corner leg 18*c*. A similar description can be made with respect to the continuous floor plane surface between the corner legs 18*c* and 18*d*, as well as between corner legs 18*b* and 18*a*. As previously described, there is a continuous diagonal floor plane surface between diagonally opposed corner legs.

Finally, there is a continuous floor plane level surface between opposite intermediate legs. By way of example, continuous floor plane surface area extends from intermediate leg 20*b* through connectors 24*a* and 24*b* in parallel to the legs of the center leg 22 and then in parallel through connectors 24*d* and 24*c* to the intermediate leg 20*d*.

Figure 3:
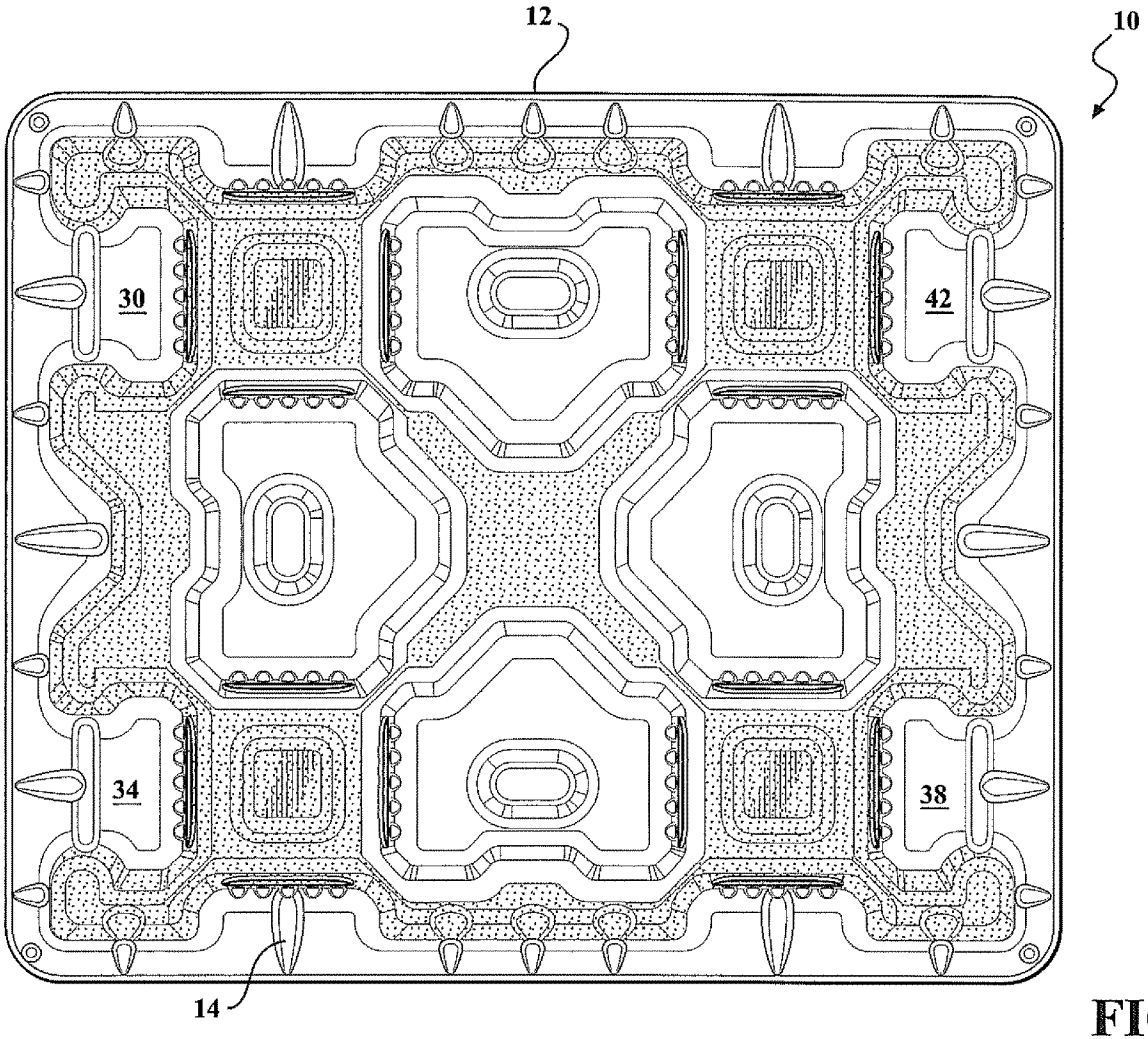
FIG. 3 shows the top of the pallet of FIG. 1 in plan view in which the shaded areas are in a lower plane than the unshaded areas.

As best shown in FIGS. 1 and 3, there are load support structures 30, 32, 34, 36, 38, 40, 42, 44 all with a top surface lying just below the plane of the curved lip 12 and in a common load plane formed by the tops of the understructure 16, the inverse of which is shown in FIG. 2. Whereas the connector structures have closed bottoms and open tops, the load structures have closed tops and open bottoms. All structures have sidewalls, most of which are shared with other structures in this single sheet design. This provides a substantial load support surface for large articles such as bags of powdered or pelletized material as well as many other types of load items. The load support surface also extends out to and around the inner area of the upwardly and outwardly curved lip 12.

Figure 5:
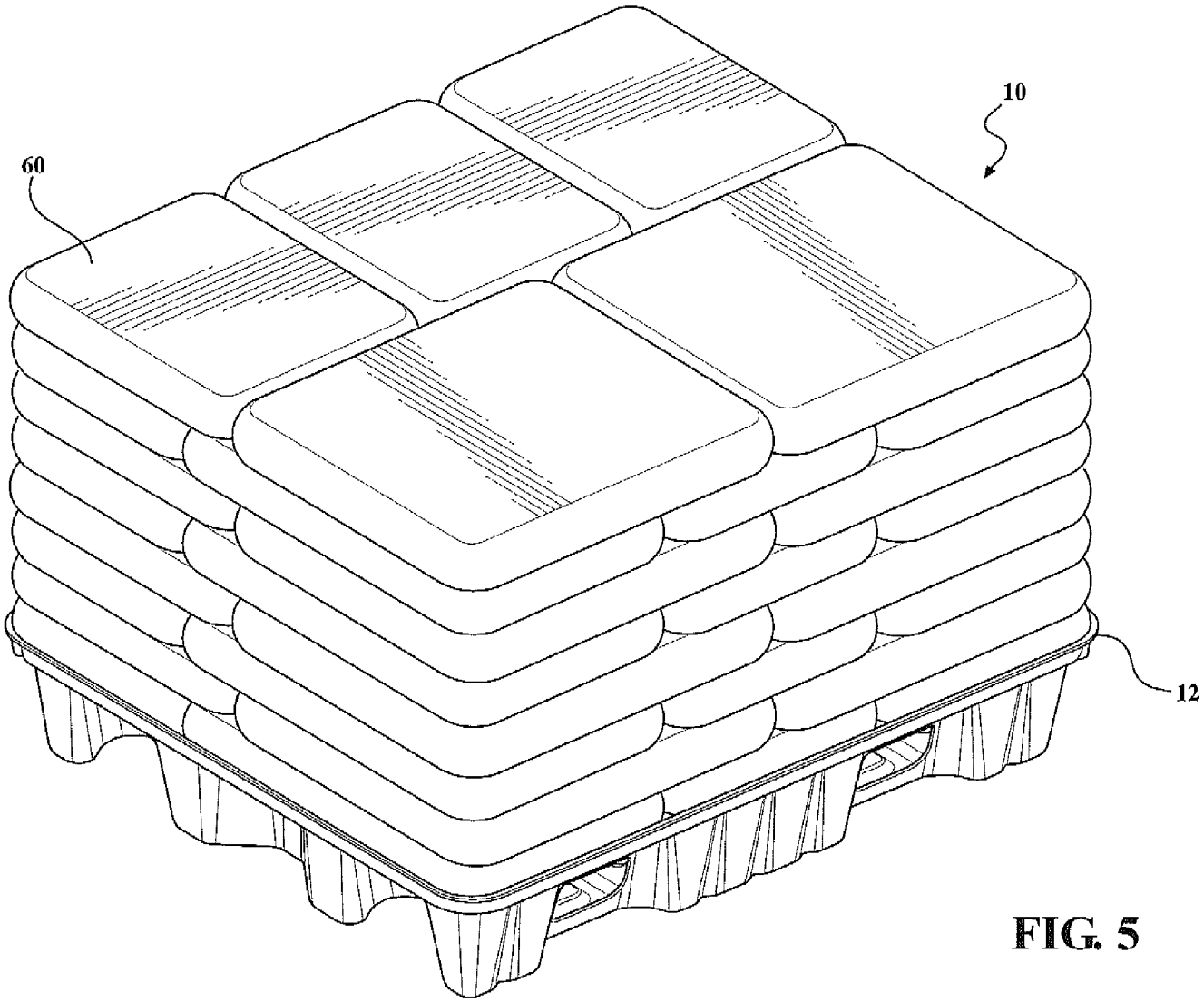
FIG. 5 shows the pallet of FIG. 1 bearing a substantial load.
Figure 6:
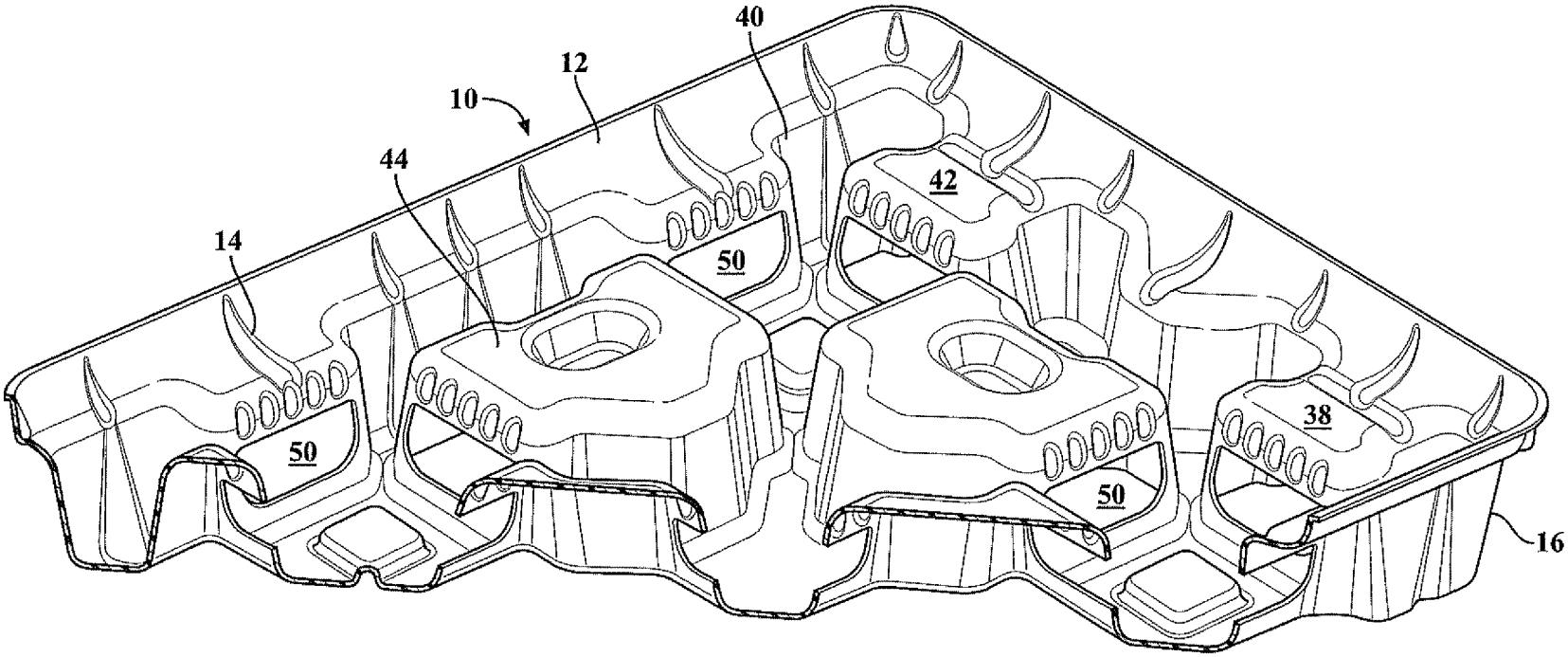
FIG. 6 is a sectional view of one corner of the pallet in an upright orientation.
Figure 7:
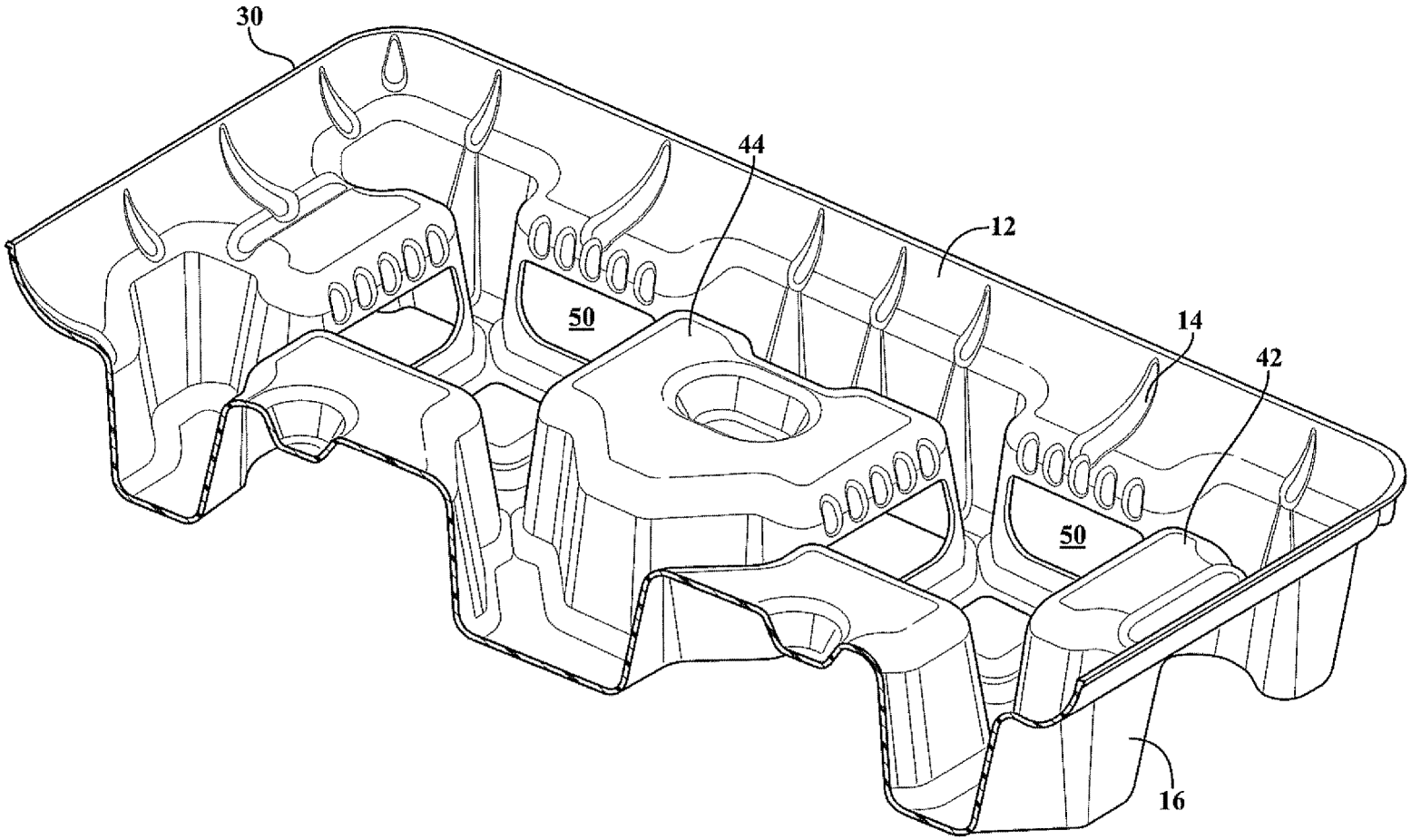
FIG. 7 is a sectional view of one end of the pallet of FIG. 1 in an upright orientation.
Figure 8:
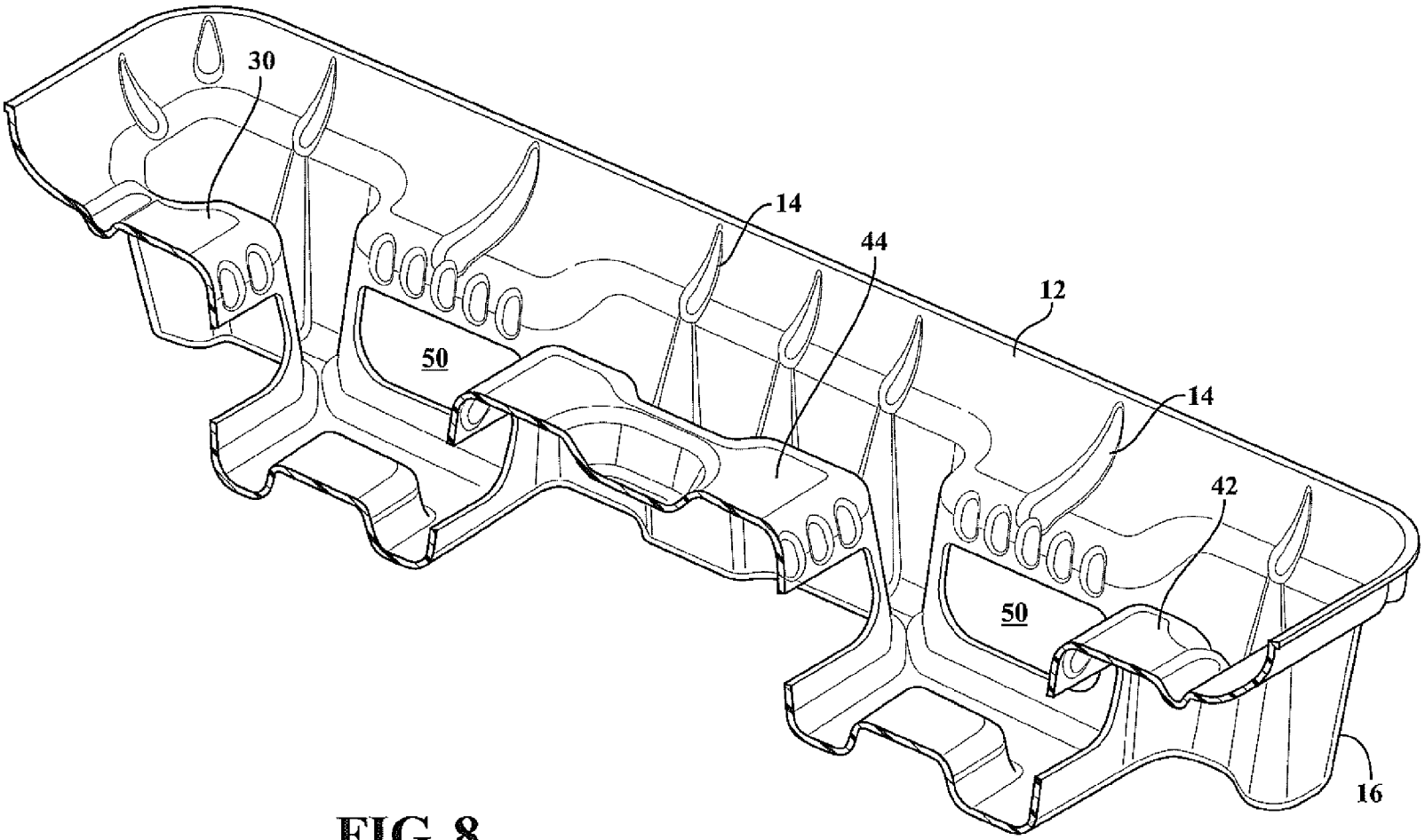
FIG. 8 is another sectional view of the pallet in an upright orientation similar to FIG. 7, but closer to the peripheral lip.
Figure 9:
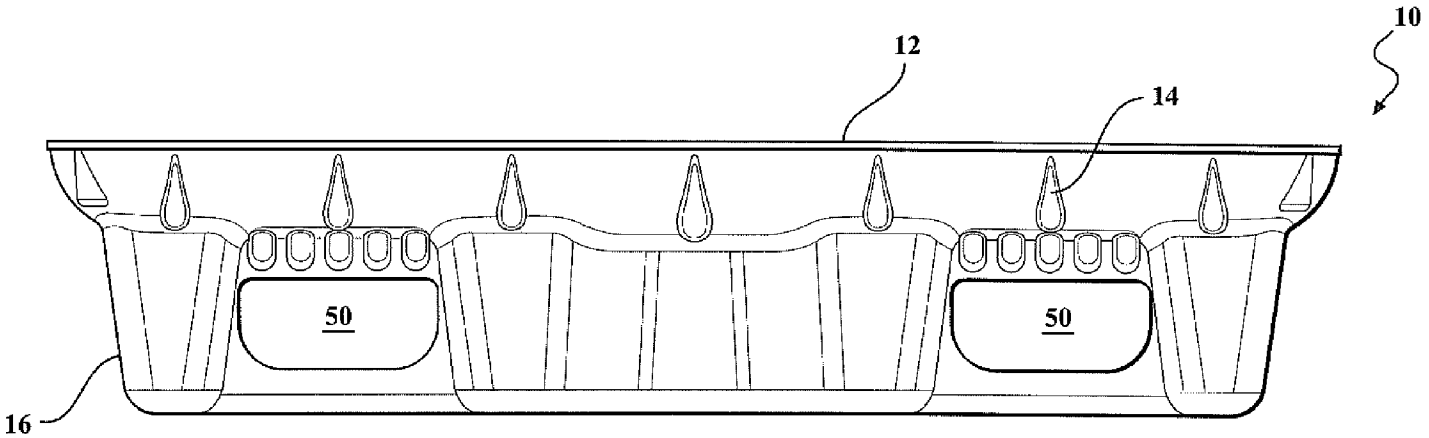
FIG. 9 is an end view of the pallet of FIG. 1 in an upright orientation showing the narrower dimension.
Figure 10:
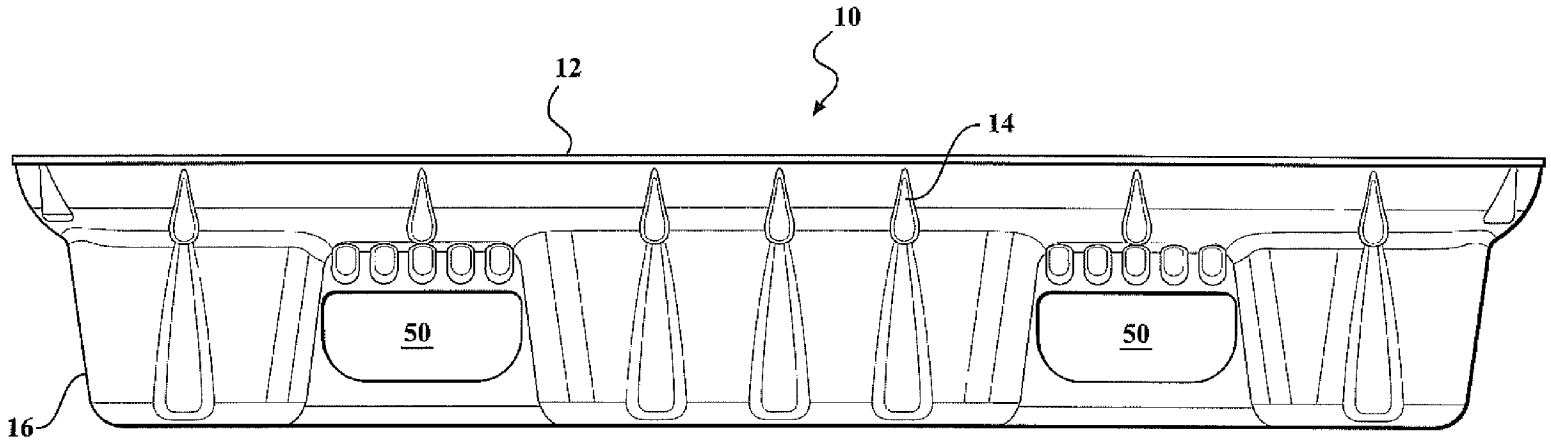
FIG. 10 is an end view of the pallet of FIG. 1 in an upright orientation showing the longer dimension.

As shown in the Figures, the vertical walls joining the box like square connector structures 24*a*, 24*b*, 24*c*, 24*d*, to surround load support structures 30, 32, 34, 36, 38, 40, 42, and 44 are trimmed out in a secondary operation to provide four spaced apart but aligned forklift openings 50 in all four directions of possible fork lift entry. These openings exist on both sides of the box like structures produced by the connectors 24*a*, 24*b*, 24*c*, 24*d*, such that a forklift can not only extend all the way through the lower structure 16 across the entire width or length of the pallet, but will also have a "safety strap" structure surrounding both of the forklift tangs which strap structure guards against inadvertent separation of a loaded pallet from a forklift truck during use, FIG. 5 shows the pallet 10 loaded with articles 60 with a typical weight of about 3300 pounds. This load may be further unitized with the pallet 10 by the addition of a stretchable plastic sleeve (not shown) which fits tightly over the stack of article 60 and which is stretched by known means so that the open end fits around and under the bottom surface of the peripheral lip 12. After the stretching members are removed, the lip of the open end of the stretchable plastic cover pulls strongly in under the lip 12 and tends to unitize the load 60 with the pallet 10 to further assist in preventing deflection thereof.

It can be seen from the Figures that a forklift can enter the openings 50 and the pallet from all four directions and drive forward so that the tangs of the forklift extend fully through or across the pallet regardless the direction of entry. The forklift tangs will add the benefit of a safety strap on the bottom side of the forklift tang to prevent inadvertent separation of the pallet from the forklift truck.

From the foregoing description, it can be seen that the pallet construction is in accordance with the principles of the present invention is made from a single sheet of material that may be thermoformed, compression molded, or injection molded to the desired shape. That pallet will, however, have the advantages of a double faced or twin sheet pallet in that it has nine legs, all of which go to a common floor plane and connectors between the legs which go to the common floor plane and add not only surface area to the floor plane, but also provide continuity both diagonally length wise and width wise so as to make the pallet compatible for movement over a roller conveyor.

It can further be seen from the configuration of the pallet as shown in FIGS. 1-4 that the pallet is fully nestable with other pallets of identical configuration and size. The upwardly curved top upper structure lip eliminates the need for metal reinforcements in the pallet; provided, however, that a designer may add metal reinforcement to the pallet if a particular situation is believed to call for it.

As previously stated, the pallet of the illustrative embodiment is thermoformed from 250 gauge HDPE in a size of approximately 1100 by 1300 millimeters and with a total unloaded weight of approximately 20 to 25 pounds.

It will be understood by those skilled in the art that the embodiment shown is illustrative in nature and that variation and modification in size, shape, material, manufacturing methods and proportions can be made. The drawings shown herein are to scale.

What is claimed is:

1. A single sheet, unitary, molded plastic pallet comprising:

a plurality of leg structures each with sidewalls extending from an open top side in a load plane to a closed surface in a floor plane, said leg structures being arranged in rows and columns and including at least one center leg;

a plurality of connector structures between the corner legs and the center leg, each having sidewalls extending from a closed bottom surface in said floor plane to a top side opening in said load plane, each of said connector structures having four corners and an integral connector rib extending from each corner to a neighboring leg structure;

a plurality of load support structures each having sidewalls extending from a closed top surface in said load plane to an open bottom, the sidewalls of said load support structures being common to the sidewalls of one of said leg structures and said connector structures;

all of said leg, connector, and load support structures being integrally formed from said single sheet; and an integral peripheral structure extending continuously around said leg, connector, and load support structures and providing a continuous lip that extends outwardly from and in a plane above said leg structures;

wherein the side surfaces of said connector structures have openings formed and aligned with one another to admit forklift tangs.

2. The single sheet unitary molded plastic pallet defined in claim 1 wherein said openings for forklift tangs are fully surrounded by side structure material.

3. A single sheet unitary molded plastic pallet as defined in claim 2, wherein the legs are nine in number and are arranged in three rows and three columns with a single center leg structure common to a row and a column, and the floor plane is diagonally continuous.

4. A single sheet unitary molded plastic pallet as defined in claim 3, wherein said center leg is of cruciform shape.

5. A single sheet unitary molded plastic pallet as defined in claim 4 wherein the portions of the leg structures and connector structures that lie in said floor plane are interconnected such that the floor plane is structurally continuous in all diagonal directions.

6. A single sheet unitary molded plastic pallet as defined in claim 5 wherein the load support structures are spaced apart from one another in said load plane and are wholly within the peripheral structure and lip.

7. A single sheet unitary molded plastic pallet as defined in claim 1, wherein said peripheral edge structure lies in a plane above the load plane and is bowl-shaped.

8. A single sheet unitary molded plastic pallet as defined in claim 1, wherein the entirety of said pallet is made of high density polyethylene.

* * * * *